US005209709A

United States Patent [19]

Eyman, Jr.

[11] Patent Number: 5,209,709

[45] Date of Patent: May 11, 1993

[54] SLIDABLE HINGE VAULTING BOARD

[76] Inventor: Waldorf C. Eyman, Jr., 12 Woodburn St., Keene, N.H. 03431

[21] Appl. No.: 675,575

[22] Filed: Mar. 25, 1991

[51] Int. Cl.[5] ..... A63B 5/08

[52] U.S. Cl. ..... 482/30; 482/26

[58] Field of Search ..... 482/26, 30, 31, 32

[56] References Cited

U.S. PATENT DOCUMENTS

| | | | |
|---|---|---|---|
| 1,210,920 | 1/1917 | Fletcher | 482/31 |
| 1,250,951 | 12/1917 | Booraem | 482/30 |
| 3,968,964 | 7/1976 | Grosser et al. | 482/31 |
| 4,460,170 | 7/1984 | Lundberg et al. | 482/31 |

FOREIGN PATENT DOCUMENTS

| | | | |
|---|---|---|---|
| 1519715 | 11/1989 | U.S.S.R. | 482/31 |

*Primary Examiner*—Richard J. Apley
*Assistant Examiner*—Lynne Reichard
*Attorney, Agent, or Firm*—Davis, Bujold & Streck

[57] ABSTRACT

A vaulting device for use by a gymnast in vaulting comprising a top member connected to a base member, via a rigid control member and a movable pivot, with a plurality of resilient members positioned between the base member and the top member to bias the base member away from the top member. When the top member is compressed toward the base member, the control arm and the movable pivot combine with one another to cause the top member to move longitudinally relative to the base member during compression and expansion strokes of the vaulting device.

20 Claims, 2 Drawing Sheets

SLIDABLE HINGE VAULTING BOARD

The present invention relates to a new and improved vaulting board which has the top board hinged to the base member by a slidable pivot arrangement.

BACKGROUND OF THE INVENTION

There are a variety of vaulting boards which are presently being used in the gymnastic field. All known prior art vaulting boards have a top board which is hinged by a fixed pivot to the base member with a plurality of springs positioned therebetween so that the resulting design produces a "clamshell" spring effect when the top vaulting board is deflected toward and away from the base member during a vault. Such vaulting boards have a recoil action which is primarily only in a vertical direction. Consequently, the recoil action of the prior art vaulting boards do not provide any horizontal momentum to the feet of the vaulter and thus do not encourage a forward or backward tumbling rotation of the vaulter when using the board during a vaulting exercise.

Wherefore, it is a primary object of the invention to provide a new and improved vaulting board in which the vaulting performance of the vaulter may be enhanced by transmitting rotational energy to the vaulter at the completion of takeoff.

A further object of the invention is to provide a vaulting board which moves in two planes.

Another object of the invention is to provide a vaulting board which is not unduly complex to use or assemble but which still provides the necessary performance for an acceptable vault to be achieved.

These and other objects of the invention will be better understood by those skilled in the art with reference to the accompanying disclosure and attached drawings.

SUMMARY OF THE INVENTION

The present invention relates to a device, for use by a gymnast in vaulting, comprising a base member defining a longitudinal axis; a top member being located adjacent said base member with resilient means connected to said top member and said base member for biasing said top member away from said base member; and slidable guide and pivot means connecting said top member to said base member for allowing said top member to pivot toward said base member and to slide along said axis relative to said base member during compression and expansion strokes of said device.

The invention also relates to a method of operating a vaulting device so it works two planes comprising the steps of:

providing a base member defining the longitudinal axis;

locating a top member adjacent said base member;

connecting said top member and said base member together with resilient means for biasing said top member away from said base member;

connecting said top member to said base member by slidable guide and pivot means for allowing said top member to pivot toward said base member as well as to slide longitudinally along the axis relative to said base member during compression and expansion strokes of said device;

depressing said top member toward said base member against said bias of the resilient means with said slidable guided and pivot means causing said top member to pivot toward said base member as well as slide longitudinally along said axis relative to said base member; and allowing said top member to be biased away from said base member by said resilient means and using the biasing energy to enhance a vaulters ability to tumble in flight when using the device.

DESCRIPTION OF THE DRAWINGS

The invention will now be described, by way of example, with reference to the accompanying drawings, in which:

Turning now to FIG. 1, the double action vaulting board 2 of the present invention will now be described in detail. The vaulting board 2 consists of one or more base members 4 pivotally supporting a top member or board 8. As can be seen in FIG. 2, it is preferred that three individual base members 4, 4' and 4'' be utilized to form the base member. The adjacent ends of each of the base members are interconnected with one another by suitable connection means 5 and 7, respectively, such as an elongate threaded rod and a plurality of nuts, to form a substantially rigid unitary base member. The top board 8 is pivoted to the base members 4 by slidable pivot means 6, the arrangement and purpose of which will be described in detail hereinafter. A guide or control arm 10, having pivots 12 and 14, is connected at one end to an inwardly facing surface of top board 8 by attachment means 13, such as screws or the like, while the other end of the control arm 10 is similarly attached to an inwardly facing surface of the base members 4 by suitable attachment means 15. The function of the control arm 10 will also be described in detail hereinafter.

Figure 1:
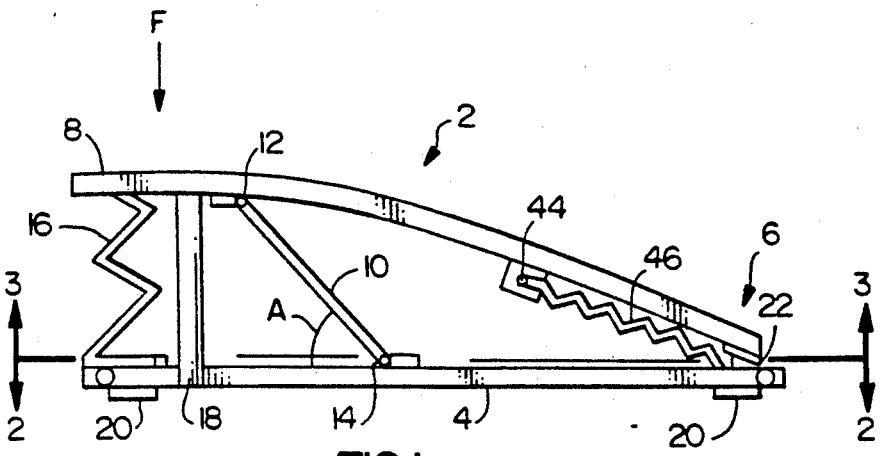
FIG. 1 is a diagrammatic side elevational view of the double action vaulting board of the present invention.
Figure 2:
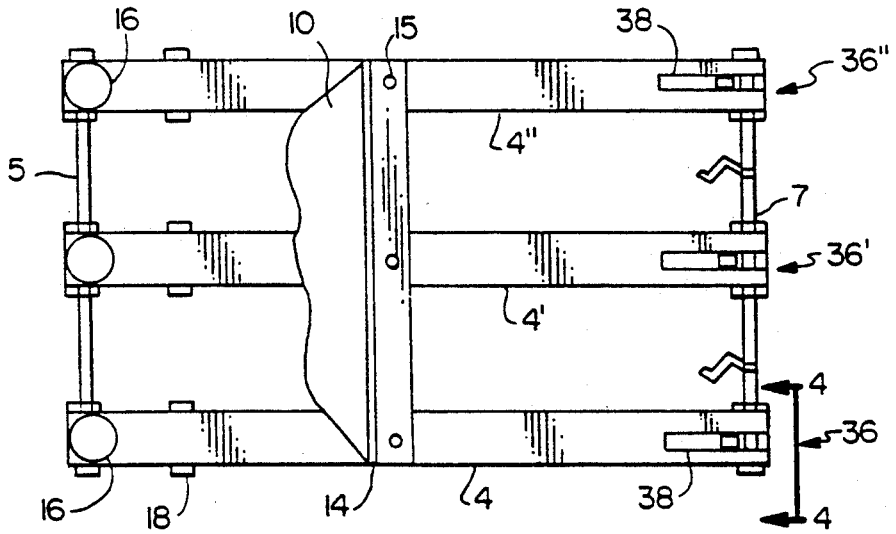
FIG. 2 is a diagrammatic view taken along section line 2—2 of FIG. 1.
Figure 3:
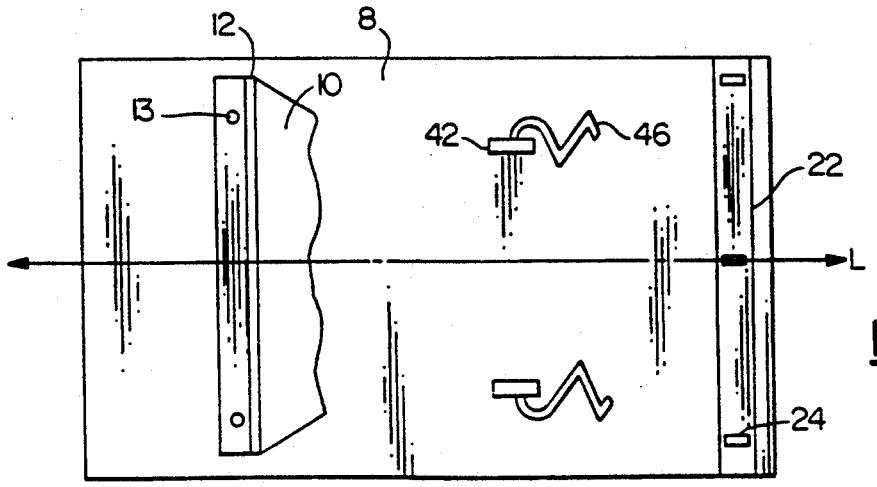
FIG. 3 is a diagrammatic view along section line 3—3 of FIG. 1.

A plurality of coil springs 16, (typically between 3 and 10 in number), are located in spaced relation between base member 4 and the top board 8 to provide the springing action of the vaulting board 2. Torsion springs could 10 also be used for this purpose. The connection of the springs 16 to the top and base members is by conventional means well known in the art and thus will not be discussed in any further detail. However, it is important to note that the number, size and the location of springs 16 will determine the compression and expansion forces to be exhibited by the vaulting board. If desired, the bottom surface of the base member 4 can be provided with a plurality of pads 20 which grip the surface or floor that the vaulting device is supported by to prevent undesired movement. In the preferred embodiment of the invention, the top board 8 is cambered. It is also possible that the base members 4, 4', 4'' may be cambered.

Turning now to FIGS. 2 through 5, the slidable pivot means 6 of the present invention will now be described in detail. It comprises a pivot support member 22 (see FIG. 3) securely fastened to the inwardly facing surface of the top board 8 and contains three pivot extensions 24 extending perpendicularly away from the inwardly facing surface. The pivot extensions 24 are spaced apart from one another so that each pivot extension can engage one of the slots 38 provided in a rearward portion of the base members 4, 4', 4". Each extension member 24 is provided with a traverse pivot hole 26 extending therethrough (see FIGS. 4 and 5), the three holes 26 being coaxial. The pivot extension members 24 are each received by a central aperture 30 in a slidable block 28 and pivot with respect to the slidable block by means of a screw or pin 34 passing through a traverse hole 32, in the slidable block 28, and the pivot hole 26 of the pivot extension member 24 (see FIG. 4). The slidable blocks 28 are received within elongate openings 36, 36', 36" of the base members 4, 4', 4". Elongate slots 38 allow longitudinal sliding movement of the slidable blocks 28 and the respective pivot extension members 24 (and thus the top board 8) relative to the base member 4.

The slidable blocks 28 are retained within the openings of the base members by the attachment means 7 and a stop (not shown) position remote from the opening. A friction reducing insert 40, such as polyamide or polytetraflourethylene (PTFE) or other similar materials, can line the interior of the base members 4 to improve the slidability of the blocks relative to the base members.

Two spring support members 42 are securely fastened to the inwardly facing surface of the top board 8 and is provided with a hole 44 for attaching a tension spring (second) 46 which extends to and is attached to connection means 7 for biasing the top board 8 rearwardly along the longitudinal axis L of the device. By this arrangement, the springs 46 causes the control arm 10 to pivot clockwise (as can be seen in FIG. 1) about pivot 14 to help return and maintain the top board 8 in a fully extended rearward position in which the springs 16 are in a minimum compression state. It is also anticipated that compression or tension spring means could be inserted inside the opening of each individual base member 4, 4', 4" to bias the respective extension member 2 and/or the slidable block 28 toward the connection means 7.

Figure 6:
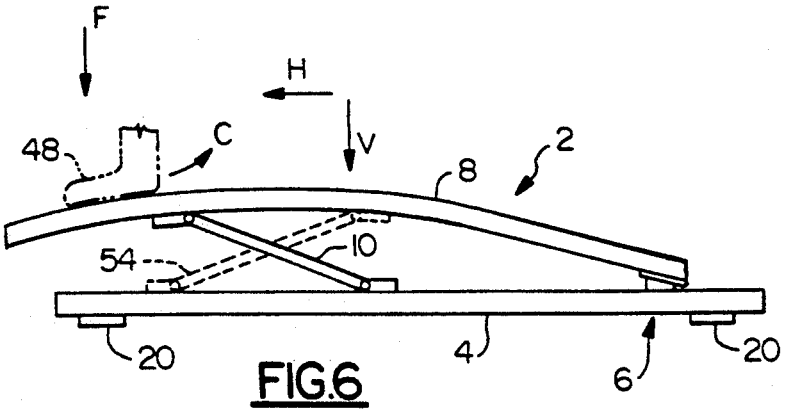
FIG. 6 is a diagrammatic side elevational view of the vaulting board of FIG. 1, shown in a compressed position, with some of the components being removed for the sake of clarity.
Figure 5:
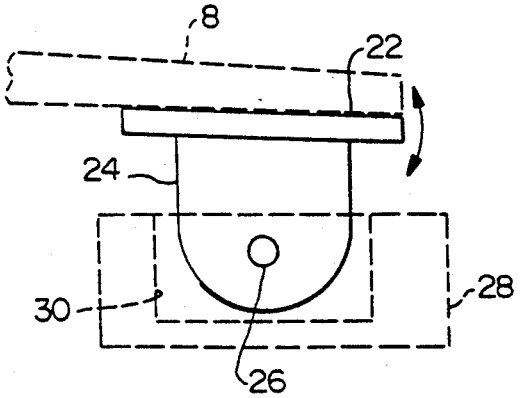
FIG. 5 is a diagrammatic view showing the engagement between an extension member and a slidable block (shown in ghost)
Figure 4:
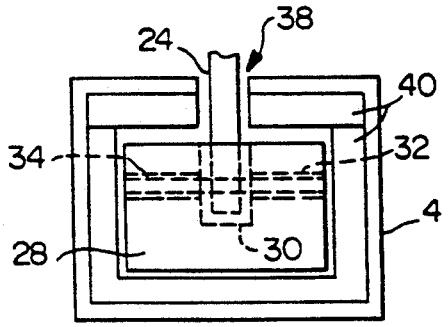
FIG. 4 is a partial diagrammatic end view in the direction of arrow 4—4 of FIG. 2.

The mechanics of the vaulting board will now be described with reference to FIGS. 1 and 6. As a vaulter jumps onto the top board 8, the feet 48 (shown in ghost) exert a downward force in a direction of arrow F and it causes the top board 8 to be compressed toward the base member 4 (see FIG. 6). Since the top board and base member are connected to one another by the rigid control arm 10, which has a fixed length, and by the slidable pivot means 6, the control arm 10 causes and the slidable pivot mean 6 allows the top board 8 to move horizontally forward (see arrow H) along the longitudinal axis L of the device as well as vertically downward (see arrow V) with respect to the base member 4. FIG. 6 shows the maximum compressed position of the top board 8 relative to the base member 4. The net effect of this compression stroke is that the top board 8 is compressed toward the base member as well as moved forward longitudinally along the base member 4. After the top board 8 has completed its compression stroke, the board recoils (springs) back to its original position by means of the coil springs 16 and the tension springs 46. The recoil motion causes the top board 8 to move longitudinally rearwardly with respect to the base member, as well as vertically away from the base member. The net effect of this return motion of the top board 8 is that the feet 48 of the vaulter using the device 2 experience a counterclockwise force C (as can be seen in FIG. 6) thereby enhancing the vaulter's ability to tumble forward in flight.

An angle A of approximately 60°, formed between the control arm and the base member 4, and a control arm length of approximately 9" has worked satisfactorily. However, by varying the angle A and/or length of the control arm 10, the characteristics of vaulting board can be adjusted to achieve various vertical to horizontal movement ratios. The arrangement shown in FIG. 1 was designed to have 2¼" of horizontal movement of the top member for every 5" of vertical movement of the top member.

It is entirely possible that the control arm 10 could be reversed, i.e. have an angle A greater than 90° and shown in ghost as 54 in FIG. 6, so that the control arm 10 would force the top board 8 rearwardly relative to the base member 4 during the compression stroke so as to encourage a clockwise rotation of the feet of the vaulter using the vaulting board 2. Such an arrangement would require a slight modification, i.e. the extensions 24 would be position adjacent the forward portion of the slots 38, instead of the rearward portion, so that the pivot extension members 24 could move rearwardly instead of forwardwardly upon depression of the top member.

Since certain changes may be made in the above described vaulting board without departing from the spirit and scope of the invention herein involved, it is intended that all matter contained herein or shown in the accompanying drawings shall be interpreted as being illustrative of the inventive concept herein involved and not limiting thereof.

Wherefore, I claim:

1. A device, for use by a gymnast in vaulting, comprising:

a base member defining a longitudinal axis;

a top member being located adjacent said base member with resilient springs extending substantially perpendicularly from said base member and directly interconnecting a first end of said top member and a first end of said base member for biasing the first end of said top member away from a first end of said base member;

means for retaining a second end of said top member adjacent a second end of said base member and for allowing said top member to pivot toward said base member and to slide along said axis relative to said base member during compression and expansion strokes of said device; and control means interconnecting said base member with said top member for controlling the relative sliding movement between said top member and said base member during the compression and the expansion strokes of said device.

2. A device according to claim 1 wherein said means for retaining comprises a slidable pivot, said control means comprises a control arm pivotally attached to an inwardly facing surface of said top member and pivotally attached to an inwardly facing surface of said base member; and said slidable pivot comprising a first member rigidly attached adjacent a transverse edge of one of said top and base members and a second member slidably connected adjacent a transverse edge of the other of said top and base members.

3. A device according to claim 2, wherein at least one second spring is provided to assist with returning the top member to its original uncompressed position whereby the resilient springs are in a minimum compression state.

4. A device according to claim 1, wherein said resilient springs comprises coil springs.

5. A device according to claim 4, wherein between 3 and 10 springs are positioned in a space relationship between said top member and said base member.

6. A device according to claim 1, wherein said resilient springs comprise coil springs.

7. A device according to claim 6, wherein between 3 and 10 springs are positioned in a space relationship between said top member and said base member.

8. A device according to claim 1, wherein said base member comprises three individual base members which are interconnected with one another by connecting members to form a substantially rigid base member.

9. A device according to claim 1, wherein said control means is connected between the first and second ends of said top member and extends at an angle of approximately 60° relative to the longitudinal axis of said base member when the device is fully expanded.

10. A device according to claim 1, wherein at least one of said top member and said base member is cambered.

11. A device according to claim 1, wherein retaining means is provided to limit biasing of the one end of said top member away from said base member during the expansion stroke.

12. A device according to claim 1, wherein said control means is a ridge member interconnecting a top surface of said base member with a bottom surface of said top member.

13. A device, for use by a gymnast in vaulting, comprising:

a base member defining a longitudinal axis;

a top member being located adjacent said base member with resilient means connected to said top member and said base member for biasing said top member away from said base member; and slidable guide and pivot means connecting said top member to said base member for allowing said top member to pivot toward said base member and to slide along said axis relative to said base member during compression and expansion strokes of said device, wherein said slidable guide and pivot means comprises a rigid control arm and a slidable pivot, said control arm being pivotally attached to an inwardly facing surface of said top member and pivotally attached to an inwardly facing surface of said base member;

said slidable pivot comprising a first member rigidly attached adjacent a transverse edge of one of said top and base members and a second member slidably connected adjacent a transverse edge of the other of said to and base members, said first member comprises a pivot support member securely fastened to an inwardly facing surface of a top member and containing three pivot extensions extending perpendicularly away from said top member, each pivot extension has a transverse pivot hole therein, and said second member is a slidable block having an aperture therein for receiving a said pivot extension and a means for connecting the pivot extension to the slidable block and allowing the pivot extension to pivot relative to the slidable block.

14. A device according to claim 13, wherein said means for connecting and allowing said pivot extension to pivot relative to said slidable block comprises a transverse hole in the slidable block and pin means engaging the transverse hole of the pivot extension and the slidable block.

15. A device according to claim 14, wherein a friction reducing insert is provided within the base member to improve the slidability of the block members relative to the base members.

16. A device according to claim 15, wherein said friction reducing insert is manufactured from one of polyamide and polytetraflourethylene.

17. A device, for use by a gymnast in vaulting, comprising:

a base member defining a longitudinal axis;

a top member located adjacent said base member with resilient springs extending substantially perpendicularly from said base member and directly interconnecting said top member with said base member for biasing said top member away from said base member;

a control arm pivotably attached to an inwardly facing surface of said top member and pivotably attached to a inwardly facing surface of said base member and slidably pivot means interconnecting a traverse edge of said top member and said base member for allowing a sliding and pivoting movement whereby said control arm and said pivot means allow said top member to pivot toward said base member as well as slide longitudinally along said axis relative to said base member during compression and expansion strokes of said device.

18. A device according to claim 17 wherein said base member comprises three individual base members which are interconnected with one another by connecting members to form a substantially rigid base member.

19. A device according to claim 17, wherein at least one of said top member and said base member is cambered.

20. A method of operating a vaulting device to work in two planes comprising the steps of:

providing a base member defining a longitudinal axis;

locating a top member adjacent said base member;

directly interconnecting a first end portion of said top member and a first end portion of said base member together with resilient springs, extending substantially perpendicularly from said base member, for biasing the first end portion of said top member away from said base member;

securing a second end of said top member to a second end of said base member by means for allowing said top member to pivot toward said base member as well as to slide longitudinally along the axis relative to said base member during compression and expansion strokes of said device;

interconnecting said base member with said top member by control means for controlling the relative sliding movement between said top member and said base member during the compression and the expansion strokes of said device;

depressing said top member toward said base member against said bias of said resilient springs with said control means causing said top member to slide longitudinally along said axis relative to said base member; and allowing said top member to be biased away from said base member by said resilient springs and using the biasing energy to enhance a vaulters ability to tumble in flight when using the device.

* * * * *